US010216142B2

(12) United States Patent
Hosoi et al.

(10) Patent No.: US 10,216,142 B2
(45) Date of Patent: Feb. 26, 2019

(54) IMAGE FORMING APPARATUS WITH CARTRIDGE HAVING REGULATION PORTION FOR GUIDING MOVEMENT OF CLEANING MEMBER

(71) Applicant: CANON KABUSHIKI KAISHA, Tokyo (JP)

(72) Inventors: Shinichiro Hosoi, Tokyo (JP); Takehiro Ishidate, Tokyo (JP); Hitoshi Iwai, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/720,644

(22) Filed: Sep. 29, 2017

(65) Prior Publication Data

US 2018/0101131 A1 Apr. 12, 2018

(30) Foreign Application Priority Data

Oct. 6, 2016 (JP) ..... 2016-198241

(51) Int. Cl.

| | |
|---|---|
| ***G03G 21/18*** | (2006.01) |
| ***G03G 15/04*** | (2006.01) |
| ***G03G 15/043*** | (2006.01) |
| ***G03G 15/02*** | (2006.01) |
| ***G03G 21/16*** | (2006.01) |

(52) U.S. Cl.

CPC ..... *G03G 21/1814* (2013.01); *G03G 15/0258* (2013.01); *G03G 15/043* (2013.01); *G03G 15/04045* (2013.01); *G03G 21/1666* (2013.01); *G03G 21/1842* (2013.01); *G03G 2221/00* (2013.01); *G03G 2221/1869* (2013.01)

(58) Field of Classification Search

CPC ..... G03G 15/04054

See application file for complete search history.

(56) References Cited

U.S. PATENT DOCUMENTS

| | | | |
|---|---|---|---|
| 6,829,002 B2 | 12/2004 | Iwai | 347/263 |
| 8,269,812 B2 | 9/2012 | Morimoto et al. | 347/257 |

(Continued)

FOREIGN PATENT DOCUMENTS

| | | |
|---|---|---|
| JP | 2010-230954 | 10/2010 |

OTHER PUBLICATIONS

U.S. Appl. No. 15/702,219, filed Sep. 12, 2017.
U.S. Appl. No. 15/706,317, filed Sep. 15, 2017.

*Primary Examiner* — Victor Verbitsky
(74) *Attorney, Agent, or Firm* — Venable LLP

(57) ABSTRACT

An image forming apparatus, including: a cartridge including a photosensitive drum and a regulation portion; a light emitting device configured to emit light from a light emission surface to the photosensitive drum; and a movement unit configured to reciprocate the light emitting device between an exposure position and a retracted position, wherein the regulation portion regulates a cleaning member, which includes a cleaning portion configured to rub and clean the light emission surface by a sliding movement of the cleaning member on the light emission surface of the light emitting device positioned at the retracted position so as to prevent the cleaning member from contacting the photosensitive drum and so as to bias the cleaning portion to prevent the cleaning portion from being separated from the light emission surface during the sliding movement of the cleaning member.

10 Claims, 13 Drawing Sheets

(56) References Cited

U.S. PATENT DOCUMENTS

| | | | | |
|---|---|---|---|---|
| 8,810,622 | B2 | 8/2014 | Mamiya et al. | 347/242 |
| 8,917,305 | B2 | 12/2014 | Nakahata et al. | 347/244 |
| 8,947,478 | B2 | 2/2015 | Ishidate et al. | 347/137 |
| 9,086,645 | B2 | 7/2015 | Otoguro et al. | G02B 26/125 |
| 9,195,063 | B2 | 11/2015 | Ishidate et al. | G03G 15/04072 |
| 9,316,992 | B2 | 4/2016 | Ishidate et al. | G03G 21/1666 |
| 9,400,444 | B2 | 7/2016 | Sato et al. | G02B 26/121 |
| 9,517,638 | B2 | 12/2016 | Otoguro et al. | G03G 15/04072 |
| 9,720,207 | B2 | 8/2017 | Otoguro et al. | G03G 2215/013 |
| 9,772,577 | B2 | 9/2017 | Ishidate et al. | G03G 15/043 |
| 2009/0245866 | A1* | 10/2009 | Ueda | G03G 21/1842 399/123 |
| 2010/0020301 | A1* | 1/2010 | Sugiyama | B41J 2/45 355/67 |
| 2016/0347083 | A1 | 12/2016 | Ishidate | B41J 2/471 |
| 2017/0010558 | A1 | 1/2017 | Ishidate et al. | B41J 2/47 |
| 2017/0064108 | A1 | 3/2017 | Mamiya et al. | H04N 1/19 |
| 2017/0371292 | A1* | 12/2017 | Narita | G03G 15/0409 |

* cited by examiner

IMAGE FORMING APPARATUS WITH CARTRIDGE HAVING REGULATION PORTION FOR GUIDING MOVEMENT OF CLEANING MEMBER

BACKGROUND OF THE INVENTION

Field of the Invention

The present invention relates to an image forming apparatus, which includes a light emitting device configured to expose a photosensitive drum to light.

Description of the Related Art

In an image forming apparatus of an electrophotographic type, such as a laser beam printer or a digital copying machine, there is provided an LED exposure head (hereinafter referred to as "LED head") as one of devices configured to expose a photosensitive drum to light. The LED head includes a predetermined number of LEDs being substantially linearly arrayed, and is configured to collectively expose a region corresponding to an image width to light. As compared to a laser scanner unit (LSU) using a rotary polygon mirror, the LED head is smaller in volume and has no drive unit, thereby being advantageous for downsizing of the apparatus and for reduction in noise.

Meanwhile, as compared to the LSU, the LED head needs to be arranged very close to the photosensitive drum due to characteristics of an exposure optical system described later. There is a case in which part of toner used in a developing process for electrophotographic image formation is scattered and flies around the photosensitive drum. There is a fear in that, when the scattered toner adheres to a light emission surface of a lens of the LED head, an exposure light amount is partially reduced to cause image failures such as density unevenness. Therefore, a cleaning member configured to periodically clean the light emission surface of the lens of the LED head is required. As one example of such a cleaning member, in Japanese Patent Application Laid-Open No. 2010-230954, there is disclosed a cleaning member to be inserted through an insertion hole formed in a housing for holding a photosensitive drum.

The cleaning member disclosed in Japanese Patent Application Laid-Open No. 2010-230954 includes a blade and a protection member. The blade moves in contact with a light emission surface of an LED head to wipe off adhering matters. The protection member is provided on a side opposite to the blade and is brought into contact with the photosensitive drum. The protection member protects the photosensitive drum so that the cleaning member is prevented from being brought into contact with the photosensitive drum and damaging the photosensitive drum. However, in some cases, when the protection member is slid in contact with the photosensitive drum, foreign matters adhering to the photosensitive drum may be rubbed against the photosensitive drum. Therefore, there is a fear in that the photosensitive drum is damaged. Further, there is also a fear in that, when the cleaning member is inserted through the insertion hole formed in the housing, a distal end portion of the cleaning member may be brought into contact with the light emission surface of the LED head to damage the light emission surface.

SUMMARY OF THE INVENTION

The present invention provides an image forming apparatus, which is configured to allow a cleaning portion of a cleaning member to reliably clean a light emission surface of a lens of a light emitting device while preventing the cleaning member from being brought into contact with a surface of a photosensitive drum.

According to one embodiment of the present invention, there is provided an image forming apparatus, which is configured to form an image on a recording medium, comprising:

a cartridge, which includes a photosensitive drum being rotatable and a regulation portion, and is detachably mounted to a main body of the image forming apparatus;

a light emitting device, comprising:

a plurality of light emitting points, which are arrayed in a direction intersecting a rotation direction of the photosensitive drum and are configured to emit light in accordance with image information so as to form an electrostatic latent image on a surface of the photosensitive drum; and a lens, which is configured to image light emitted from the plurality of light emitting points on the surface of the photosensitive drum and has a light emission surface configured to emit the light from the plurality of light emitting points and arranged opposite to the surface of the photosensitive drum; and a movement unit configured to reciprocate the light emitting device between an exposure position and a retracted position, the exposure position being a position for formation of the electrostatic latent image and being a position at which the light emission surface is positioned closer to the surface of the photosensitive drum with respect to the regulation portion, the retracted position being a position retracted from the exposure position and being a position at which the light emission surface is positioned on a side opposite to the surface of the photosensitive drum with respect to the regulation portion, wherein the regulation portion regulates a cleaning member, which includes a cleaning portion configured to rub and clean the light emission surface by a sliding movement of the cleaning member in a longitudinal direction of the light emitting device on the light emission surface of the light emitting device positioned at the retracted position, so as to prevent the cleaning member from being brought into contact with the surface of the photosensitive drum and so as to bias the cleaning portion against the light emission surface to prevent the cleaning portion from being separated from the light emission surface in the longitudinal direction of the light emitting device during the sliding movement of the cleaning member.

Further features of the present invention will become apparent from the following description of exemplary embodiments with reference to the attached drawings.

DESCRIPTION OF THE EMBODIMENTS

Now, a description will be provided of embodiments of the present invention with reference to the accompanying drawings.

First Embodiment (Image Forming Apparatus)

Figure 1:
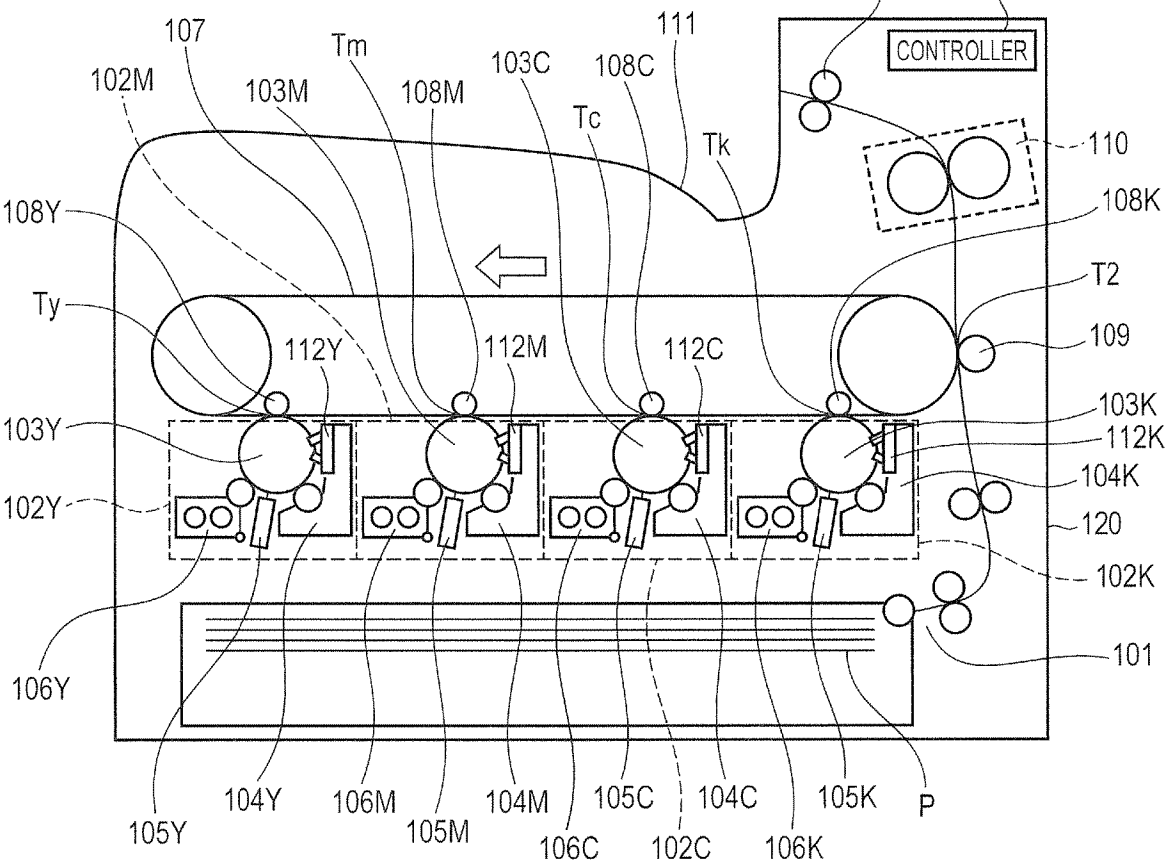
FIG. 1 is a sectional view of an image forming apparatus.

With reference to FIG. 1, a description will be provided of one example of an image forming apparatus of an electrophotographic type according to a first embodiment. FIG. 1 is a sectional view of an image forming apparatus 100. FIG. 1 is an illustration of one example of the image forming apparatus 100 of a tandem type including photosensitive drums 103 (103Y, 103M, 103C, and 103K) being photosensitive members (image bearing members) for use in formation of toner images of yellow, magenta, cyan, and black. The toner images of respective colors are superimposed on one another on an intermediate transfer belt 107 being an intermediate transfer member. The toner images superimposed on the intermediate transfer belt 107 are collectively transferred to a sheet (hereinafter referred to as "recording sheet") serving as a recording medium.

The image forming apparatus 100 includes image forming portions 102Y, 102M, 102C, and 102K which are configured to form toner images of yellow (Y), magenta (M), cyan (C), and black (K), respectively. The image forming portions 102Y, 102M, 102C, and 102K include photosensitive drums 103Y, 103M, 103C, and 103K which are rotatable, respectively. Herein, the indices Y, M, C, and K of the reference symbols represent yellow, magenta, cyan, and black, respectively. In the following description, the indices Y, M, C, and K of the reference symbols are omitted unless otherwise required. In a periphery of the photosensitive drum 103, there are arranged a charger 104, an LED head 105, and a developing device 106. The charger 104 is configured to charge a surface of the photosensitive drum 103. The LED head 105 is configured to expose the photosensitive drum 103 to light in accordance with image information. The developing device 106 is configured to develop an electrostatic latent image on the photosensitive drum 103 with toner. The photosensitive drums 103 are held in contact with the intermediate transfer belt 107. Primary transfer rollers 108Y, 108M, 108C, and 108K form primary transfer portions Ty, Tm, Tc, and Tk between the intermediate transfer belt 107 and the photosensitive drums 103Y, 103M, 103C, and 103K, respectively. Cleaning members 112Y, 112M, 112C, and 112K are configured to remove toner which remains on the surfaces of the photosensitive drums 103 after the primary transfer. The image forming portions 102Y, 102M, 102C, and 102K have substantially the same structure except for colors of toner.

(Image Forming Process)

Now, a description will be provided of an image forming process. The chargers 104Y, 104M, 104C, and 104K uniformly charge the surfaces of the photosensitive drums 103Y, 103M, 103C, and 103K. The LED heads 105Y, 105M, 105C, and 105K irradiate light to the uniformly charged surfaces of the photosensitive drums 103Y, 103M, 103C, and 103K to form electrostatic latent images thereon in accordance with image information. The electrostatic latent images are developed by the developing devices 106Y, 106M, 106C, and 106K with toners of respective colors, thereby forming toner images. The toner images of respective colors are primarily transferred in a sequential manner onto the intermediate transfer belt 107 at the primary transfer portions Ty, Tm, Tc, and Tk, and are superimposed on one another. The toner images of respective colors superimposed on one another on the intermediate transfer belt 107 are secondarily transferred in a collective manner to a recording sheet (recording medium) P, which has been conveyed from a sheet-feeding portion 101, by a secondary transfer roller 109 at a secondary transfer portion T2. The recording sheet P having the toner images transferred thereon is conveyed to a fixing device 110. The fixing device 110 applies heat and pressure to the recording sheet P to fix the toner images on the recording sheet P, thereby forming a color image on the recording sheet P. The recording sheet P having the color image formed thereon is delivered by a delivery roller 28 to a delivery tray 111.

(LED Head)

Figure 2:
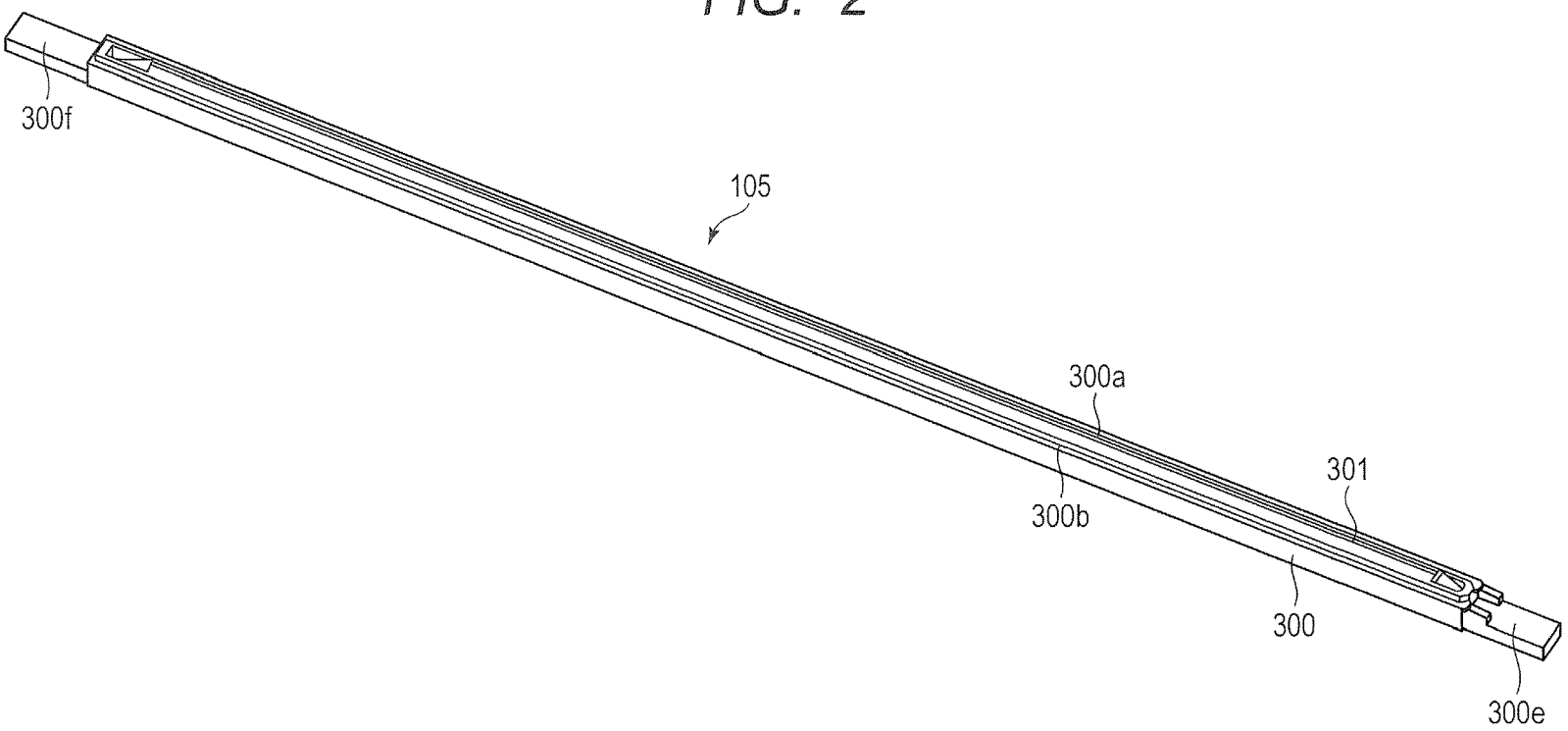
FIG. 2 is a perspective view of an LED head.
Figure 3:
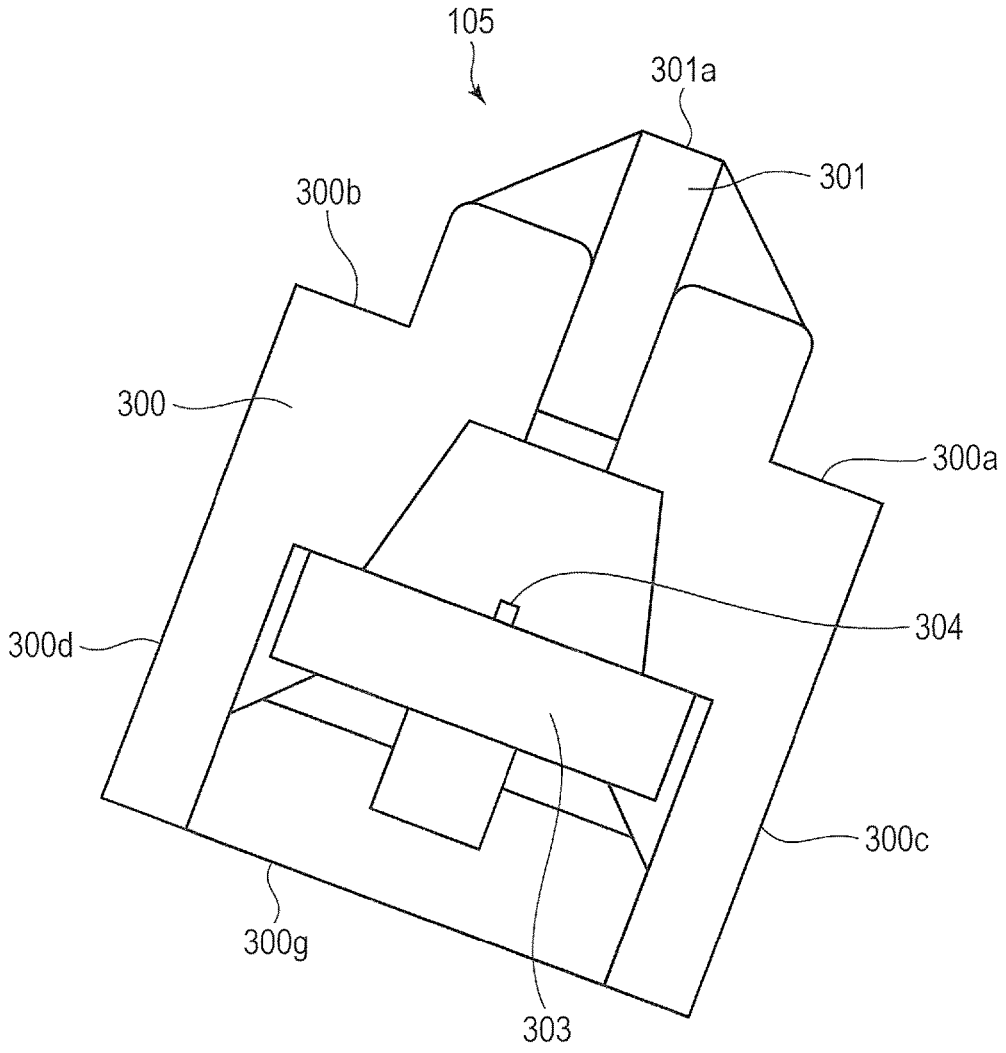
FIG. 3 is a sectional view of the LED head.

Now, with reference to FIG. 2 and FIG. 3, a description will be provided of the LED head 105 serving as an exposure unit. FIG. 2 is a perspective view of the LED head 105. FIG. 3 is a sectional view of the LED head. The LED head 105 is a solid light source. The LED head 105 has an elongated shape extending in one direction. The LED head 105 is arranged along a direction substantially parallel to a rotary axis of the photosensitive drum 103 in a main body 120 of the image forming apparatus 100. The direction substantially parallel to the rotary axis of the photosensitive drum 103 corresponds to a longitudinal direction of the LED head 105. The LED head 105 serving as a light emitting device (solid exposure device) includes a plurality of light emitting elements (hereinafter referred to as "light emitting points") 304, which are arrayed and configured to emit light in accordance with image information transmitted from a controller 130 or an external device (not shown) so as to expose the surface of the photosensitive drum 103 to light. The plurality of light emitting points 304 are arrayed in a single line extending in a direction intersecting or substantially crossing a rotation direction of the photosensitive drum 103. However, the plurality of light emitting points 304 may be arrayed in a plurality of lines each extending in the direction intersecting the rotation direction of the photosensitive drum 103. Further, a plurality of light emitting chips each including the plurality of light emitting points 304 may be arrayed with a staggered arrangement in two lines in the rotation direction of the photosensitive drum 103. As the light emitting points 304, there may be used liquid crystal elements, semiconductor light emitting diodes, organic EL elements, or electroluminescent elements. The LED head 105 of the first embodiment includes an LED-mount board 303 on which a light emitting diode array being one example of the light emitting points 304 is mounted. Further, the LED head 105 includes a lens assembly 301 configured to image the light emitted from the light emitting points 304 on the surface of the photosensitive drum 103. In the lens assembly (lenses) 301 being an imaging member, a plurality of columnar rod lenses which allow passage of light therethrough are integrated. The lens assembly 301 has a light emission surface 301*a* through which light is emitted. A light entry surface with respect to the light emission surface 301*a* is opposed to the light emitting points 304 in an optical axis direction of the lenses of the lens assembly 301. The light emitted from the light emitting points 304 enters the lens array 301 through the light entry surface and is emitted through the light emission surface 301*a*. The light emission surface 301*a* is opposed to the surface of the photosensitive drum 103. As the lens assembly 301, there has been known, for example, a Selfoc (trademark) lens. The LED mount board 303 and the lens assembly 301 are positioned with high accuracy by a housing 300.

(Cartridge)

The image forming portions 102Y, 102M, 102C, and 102K are each constructed as a cartridge which is detachably mounted to the main body 120 of the image forming apparatus 100. The cartridge of the first embodiment is a so-called separation-type process cartridge constructed by a developing cartridge 400 and a drum cartridge 500. However, the cartridge may be a so-called integration-type process cartridge integrally including the photosensitive drum 103 and a developing roller 401. In the first embodiment, the drum cartridge 500 integrally includes the photosensitive drum 103 and the charger 104. However, it is only necessary that the drum cartridge 500 include at least the photosensitive drum 103. The drum cartridge 500 may integrally include the photosensitive drum 103, the charger 104, and the cleaning member 112 configured to remove toner remaining on the surface of the photosensitive drum 103. In the first embodiment, the developing cartridge 400 integrally includes the developing roller 401 and a developer container 408 configured to receive developer to be fed to the developing roller 401. However, it is only necessary that the developing cartridge 400 include at least the developing roller 401.

(Developing Device)

Figure 4A:
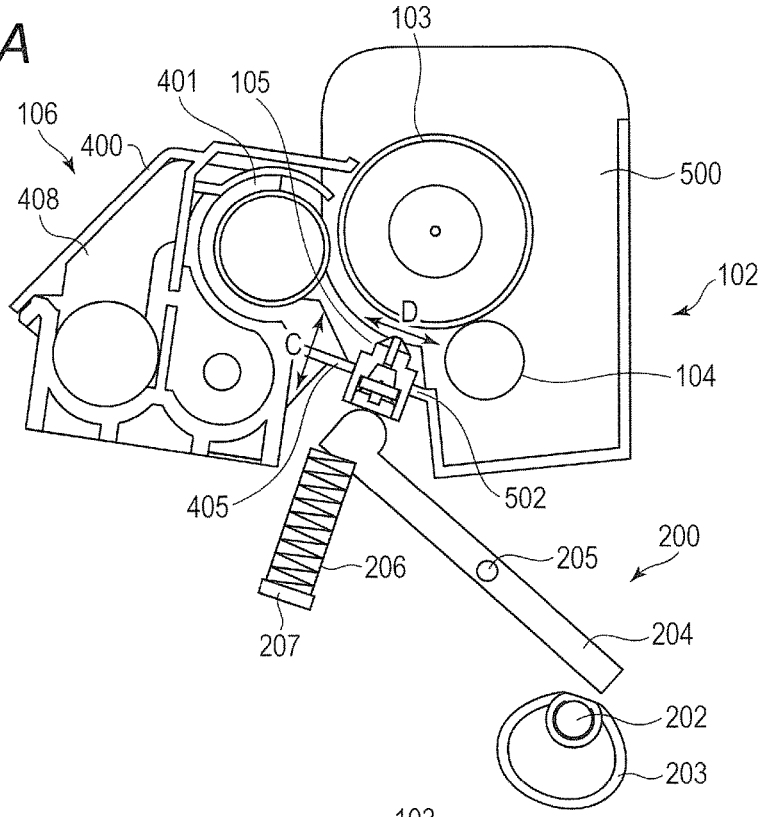
FIG. 4A and FIG. 4B are sectional views of an image forming portion.
Figure 4B:
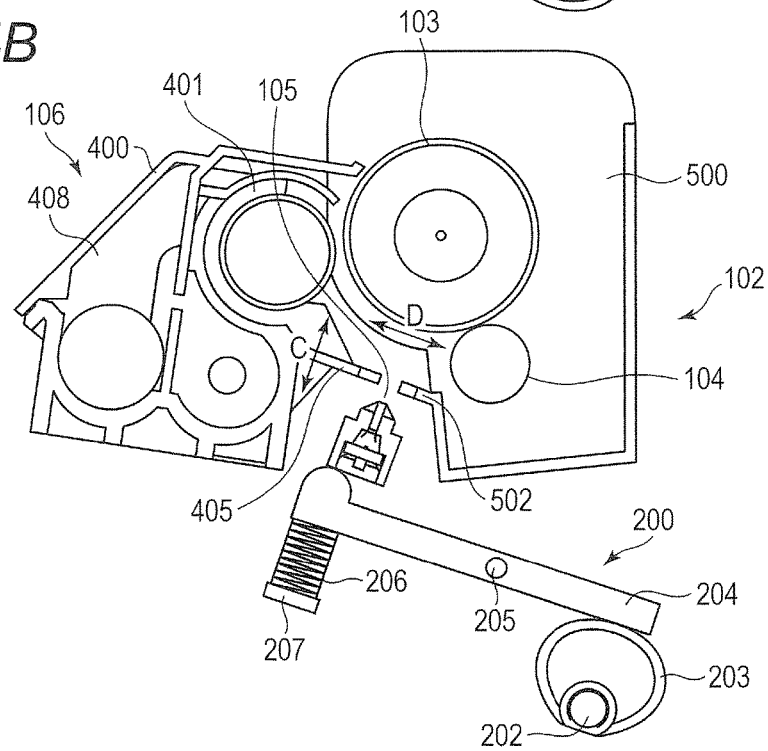
Figure 5:
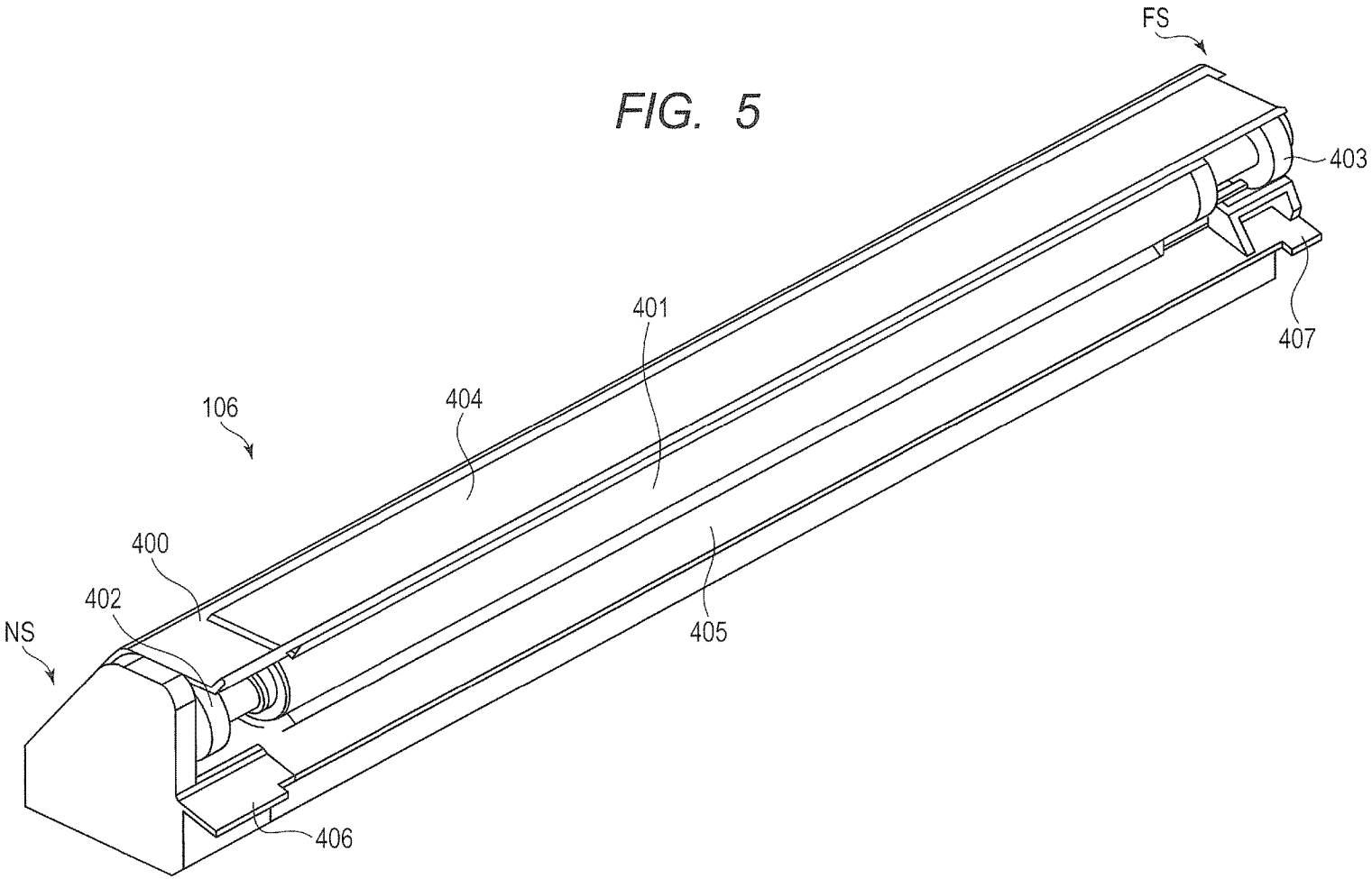
FIG. 5 is a perspective view of a developing device.

Now, with reference to FIG. 4A, FIG. 4B, and FIG. 5, a description will be provided of the developing device 106. FIG. 4A and FIG. 4B are sectional views of the image forming portion 102. FIG. 4A is a sectional view of the image forming portion 102 under a state in which the LED head 105 is at an exposure position. During the image formation, the LED head 105 is at the exposure position illustrated in FIG. 4A. The exposure position is a position for forming an electrostatic latent image. FIG. 4B is a sectional view of the image forming portion 102 under a state in which the LED head 105 is at a retracted position apart from the photosensitive drum 103. The retracted position is a position retracted from the exposure position. During the cleaning, the LED head 105 is at the retracted position illustrated in FIG. 4B. FIG. 5 is a perspective view of the developing device 106. The developing device 106 is constructed by the developing cartridge 400. The developing cartridge 400 is mountable to and detachable from the main body 120 of the image forming apparatus 100. The developing cartridge 400 includes the developing roller (developing member) 401 and a developing frame 404 serving as a second support member configured to support the developing roller 401. The developing roller 401 is supported by the developing frame 404 through intermediation of flanges 402 and 403 arranged at both end portions of the developing roller 401 in the longitudinal direction.

The developing frame 404 includes second regulation portions (405, 406, and 407) protruding from the developing frame 404. The second regulation portions (405, 406, and 407) include a near side regulation portion 406, a far side regulation portion 407, and a longitudinal direction regulation portion 405. The near side regulation portion 406 is provided on a near side NS of the image forming apparatus 100. The far side regulation portion 407 is provided on a far side FS of the image forming apparatus 100. The longitudinal direction regulation portion 405 extends between the near side regulation portion 406 and the far side regulation portion 407. In the following description, the near side regulation portion 406, the far side regulation portion 407, and the longitudinal direction regulation portion 405 are simply referred to as a regulation portion 406, a regulation portion 407, and a regulation portion 405, respectively. The regulation portion 405 serves as a regulation portion configured to regulate movement of a cleaning member 600 toward the photosensitive drum 103 during cleaning of the lens assembly 301. Further, the regulation portion 405 also serves as a positioning unit configured to position the LED head 105 in a direction indicated by the arrow D of FIG. 4A and FIG. 4B (substantially horizontal direction) during an approach/separation operation of the LED head 105 with respect to the photosensitive drum 103. The regulation portions 406 and 407 serve as positioning portions configured to position the LED head 105 in a direction indicated by the arrow C of FIG. 4A and FIG. 4B (substantially vertical direction) at the exposure position at which the LED head 105 is close to the photosensitive drum 103. The approach/separation operation of the LED head 105 with respect to the photosensitive drum 103 is described later.

(Drum Cartridge)

Figure 6:
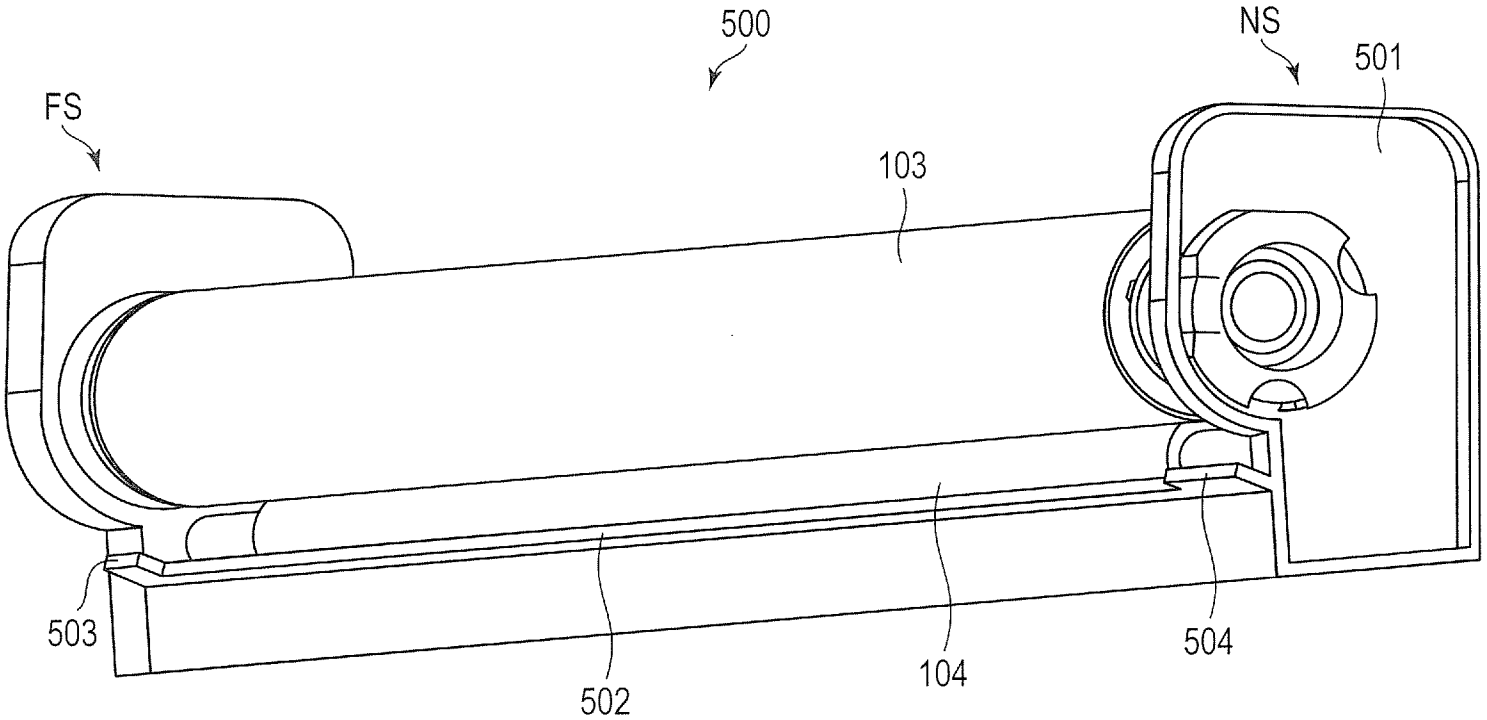
FIG. 6 is a perspective view of a drum cartridge.

Now, with reference to FIG. 4A, FIG. 4B, and FIG. 6, a description will be provided of the drum cartridge 500. FIG. 6 is a perspective view of the drum cartridge 500. The drum cartridge 500 is mountable to and detachable from the main body 120 of the image forming apparatus 100. The drum cartridge 500 includes the photosensitive drum 103, the charger (charging roller) 104, and a drum frame 501 serving as a first support member configured to support the photosensitive drum 103 and the charger 104. The photosensitive drum 103 and the charger 104 are supported by the drum frame 501 through intermediation of flanges (not shown) arranged at both end portions of each of the photosensitive drum 103 and the charger 104 in the longitudinal direction.

The drum frame 501 includes first regulation portions (502, 503, and 504) protruding from the drum frame 501. The first regulation portions (502, 503, and 504) include a near side regulation portion 504, a far side regulation portion 503, and a longitudinal direction regulation portion 502. The near side regulation portion 504 is provided on the near side NS of the image forming apparatus 100. The far side regulation portion 503 is provided on the far side FS of the image forming apparatus 100. The longitudinal direction regulation portion 502 extends between the near side regulation portion 504 and the far side regulation portion 503. In the following description, the near side regulation portion 504, the far side regulation portion 503, and the longitudinal direction regulation portion 502 are simply referred to as a regulation portion 504, a regulation portion 503, and a regulation portion 502, respectively. During cleaning of the lens assembly 301, the regulation portion 502 is interposed between the photosensitive drum 103 and the cleaning member 600 to prevent the cleaning member 600 from being brought into contact with the surface of the photosensitive drum 103. Further, during cleaning of the lens assembly 301, the regulation portion 502 serves to bias a cleaning pad 602 against the light emission surface 301*a* of the lens assembly 301 while the cleaning member 600 is slidingly moved in the longitudinal direction of the LED head 105. Further, the regulation portion 502 also serves as a positioning unit configured to position the LED had 105 in the direction indicated by the arrow D of FIG. 4A and FIG. 4B during the approach/separation operation of the LED head 105 with respect to the photosensitive drum 103. The regulation portions 503 and 504 serve as positioning portions configured to position the LED head 105 in the direction indicated by the arrow C of FIG. 4A and FIG. 4B at the exposure position at which the LED head 105 is close to the photosensitive drum 103. The approach/separation operation of the LED head 105 with respect to the photosensitive drum 103 will be described later.

When the developing frame 404 and the drum frame 501 are mounted to the main body 120 of the image forming apparatus 100, the first regulation portions (502, 503, and 504) are arranged opposite to the second regulation portions (405, 406, and 407).

(Approach/Separation Mechanism for LED Head)

Figure 7A:
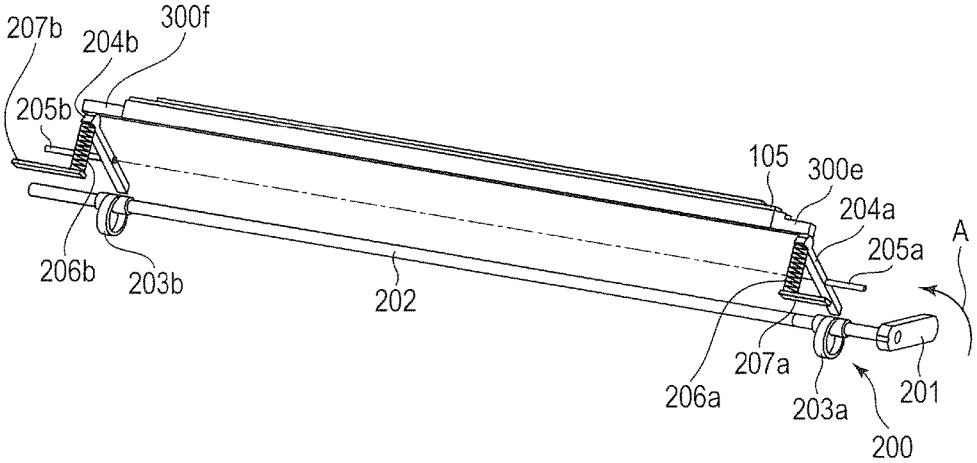
FIG. 7A and FIG. 7B are perspective views of an approach/separation mechanism.
Figure 7B:
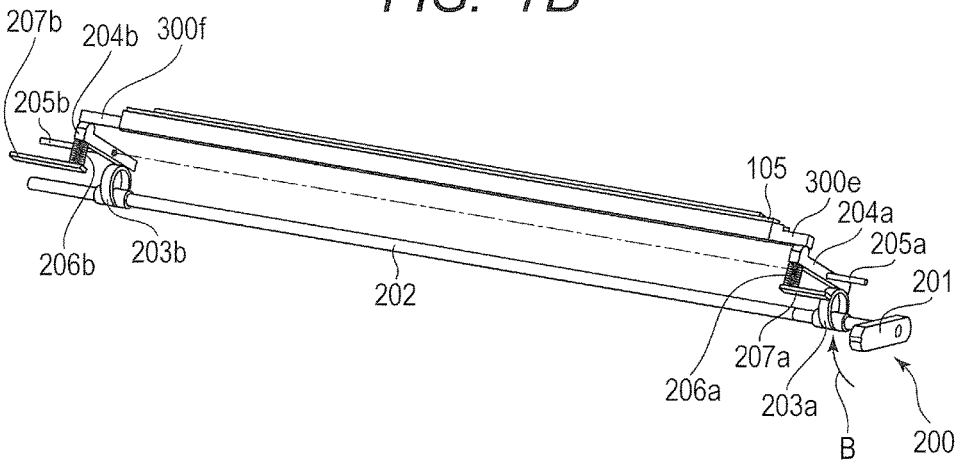
Figure 8:
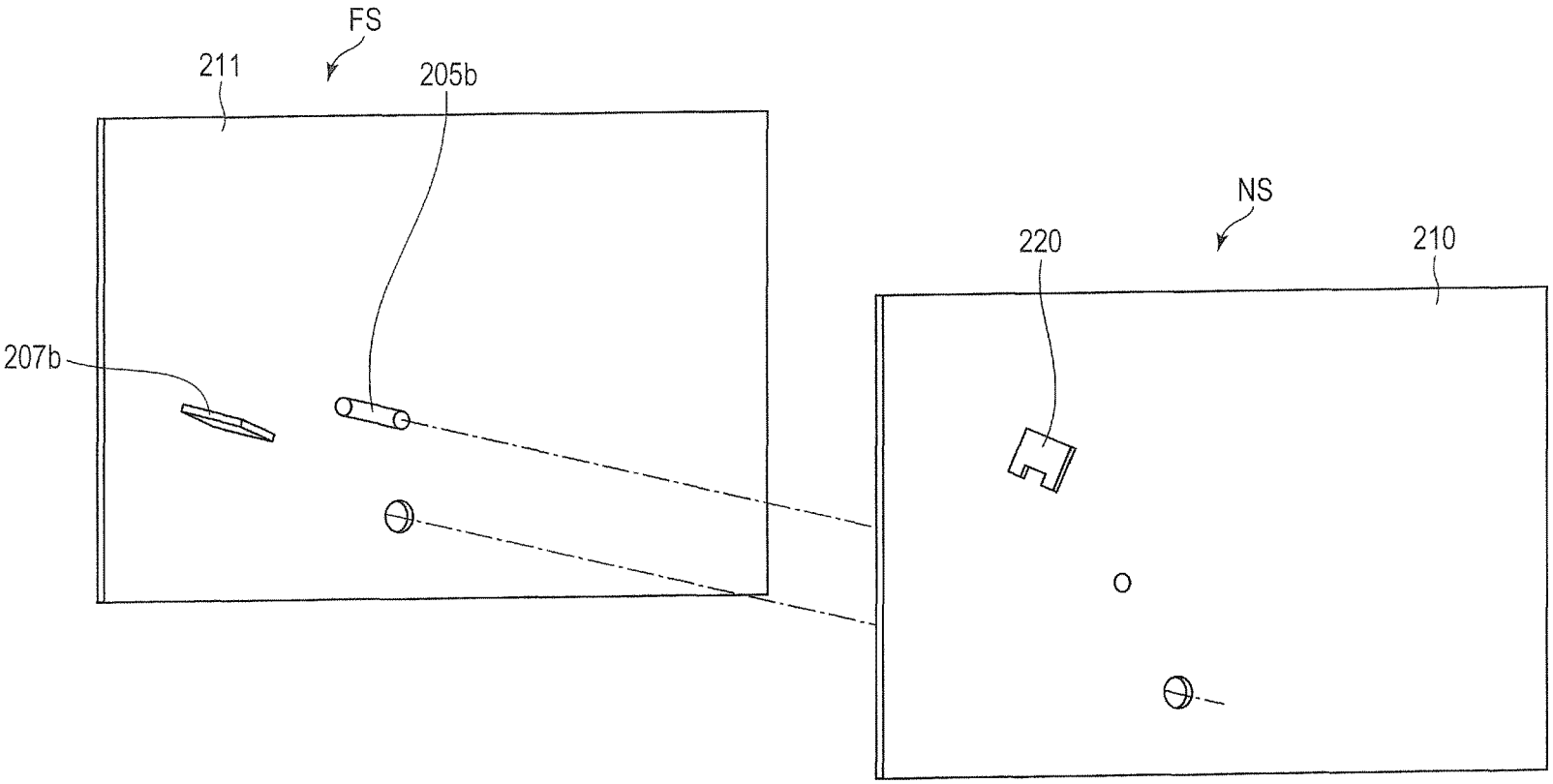
FIG. 8 is a perspective view of main body frames.
Figure 9A:
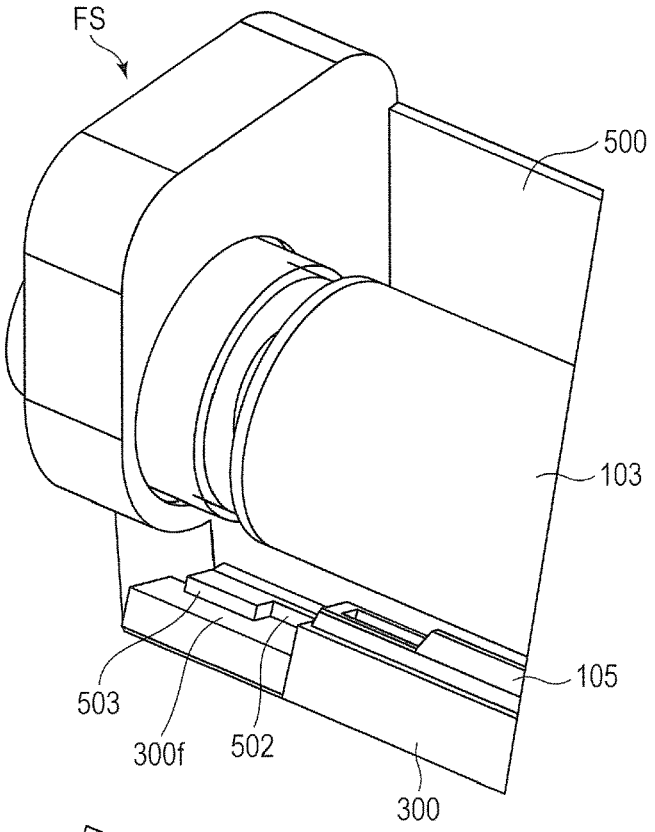
FIG. 9A and FIG. 9B are perspective views of the drum cartridge.
Figure 9B:
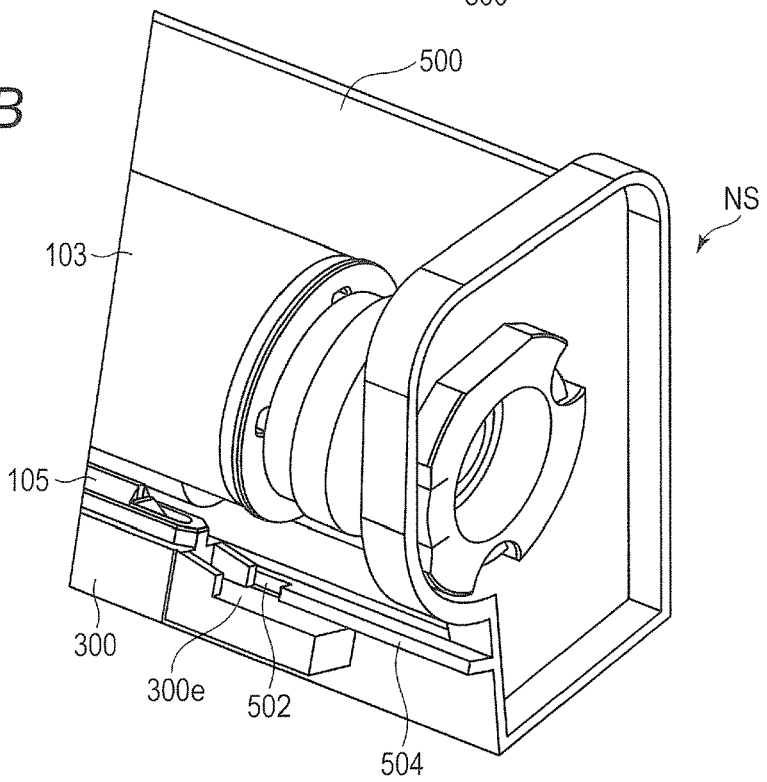

Now, with reference to FIG. 4A, FIG. 4B, FIG. 7A, FIG. 7B, FIG. 8, FIG. 9A, and FIG. 9B, a description will be provided of an approach/separation mechanism (movement unit) 200 for the LED head 105. FIG. 7A and FIG. 7B are perspective views of the approach/separation mechanism 200. FIG. 7A is a perspective view of the approach/separation mechanism 200 under the state in which the LED head 105 is at the exposure position. During the image formation, the LED head 105 is at the exposure position illustrated in FIG. 7A. FIG. 7B is a perspective view of the approach/separation mechanism 200 under the state in which the LED head 105 is at the retracted position apart from the photosensitive drum 103. During the cleaning, the LED head 105 is at the retracted position illustrated in FIG. 7B. FIG. 8 is a perspective view of main body frames 210 and 211. FIG. 9A and FIG. 9B are perspective views of the drum cartridge 500. FIG. 9A is a perspective view for illustrating a portion of the drum cartridge 500 on the far side FS of the image forming apparatus 100 when the LED head 105 is at the exposure position. FIG. 9B is a perspective view for illustrating a portion of the drum cartridge 500 on the near side NS of the image forming apparatus 100 when the LED head 105 is at the exposure position.

The approach/separation mechanism 200 is configured to reciprocate the LED head 105 between the exposure position at which the LED head 105 is close to the photosensitive drum 103 for image formation and the retracted position at which the LED head 105 is apart from the photosensitive drum 103 for cleaning. That is, the LED head 105 is movable between the exposure position and the retracted position by the approach/separation mechanism 200. When the LED head 105 is at the exposure position, the light emission surface 301*a* is positioned closer to the surface of the photosensitive drum 103 with respect to the regulation portions 406 and 504, and the plurality of light emitting points 304 emit light to expose the surface of the photosensitive drum 103 to light. When the LED head 105 is at the retracted position, the light emission surface 301*a* is positioned on a side opposite to the surface of the photosensitive drum 103 with respect to the regulation portions 406 and 504, and the LED head 105 is retracted from the exposure position. When the LED head 105 is at the retracted position, the drum cartridge 500 is mountable to and detachable from the main body 120 of the image forming apparatus 100.

As illustrated in FIG. 7A and FIG. 7B, the approach/separation mechanism 200 includes a lever 201, a shaft 202, cams 203*a* and 203*b*, links 204*a* and 204*b*, link shafts 205*a* and 205*b*, compression springs 206*a* and 206*b*, and spring seats 207*a* and 207*b*. As illustrated in FIG. 8, the main body 120 of the image forming apparatus 100 includes the main body frame 210 and the main body frame 211. The main body frame 210 is arranged on the near side NS of the image forming apparatus 100. The main body frame 211 is arranged on the far side FS of the image forming apparatus 100. The lever 201 is arranged on a side opposite to the LED head 105 with respect to the main body frame 210. On respective inner sides of the main body frames 210 and 211, the cams 203*a* and 203*b* illustrated in FIG. 7A and FIG. 7B are arranged. The lever 201 and the cams 203*a* and 203*b* are fixed to the same shaft 202. The rotational movement of the lever 201 causes rotation of the shaft 202, thereby changing phases (rotational positions) of the cams 203*a* and 203*b*.

The main body frames 210 and 211 include the link shafts 205*a* and 205*b* protruding from the respective inner sides of the main body frames 210 and 211. The links 204*a* and 204*b* are arranged on the respective inner sides of the main body frames 210 and 211. As illustrated in FIG. 7A and FIG. 7B, the links 204*a* and 204*b* are supported by the link shafts 205*a* and 205*b*, respectively, so that the links 204*a* and 204*b* are rotatable about the link shafts 205*a* and 205*b*. One end portion of the link 204*a* is engaged with a lower surface of one end portion 300*e* of the LED head 105, and another end portion of the link 204*a* is engaged with the cam 203*a*. One end portion of the link 204*b* is engaged with a lower surface of another end portion 300*f* of the LED head 105, and the another end portion of the link 204*b* is engaged with the cam 203*b*. The compression spring 206*a* is arranged between the spring seat 207*a* protruding from the main body frame 210 and the one end portion of the link 204*a*. The compression spring 206*b* is arranged between the spring seat 207*b* protruding from the main body frame 211 and the one end portion of the link 204*b*. The compression springs 206 (206*a* and 206*b*) are biasing members configured to bias the LED head 105 toward the exposure position.

The approach/separation mechanism 200 moves the LED head 105 to the exposure position and the retracted position in conjunction with movement of the lever 201 operated by a user. When the lever 201 is rotated in a direction indicated by the arrow B of FIG. 7B, as illustrated in FIG. 7A, the engagement of the another end portions of the links 204 with the cams 203 is released, and the compression springs 206 press the LED head 105 upward through intermediation of the one end portions of the links 204. In order to prevent the lens assembly 301 of the LED head 105 from being brought into contact with the surface of the photosensitive drum 103, the regulation portions 406, 407, 503, and 504 serving as the regulation units regulate the movement of the LED head 105. That is, when the LED head 105 is pressed upward by the compression springs 206, the one end portion 300*e* of the housing 300 in the longitudinal direction of the LED head 105 abuts against the regulation portions 406 and 504 (see FIG. 9B), and the another end portion 300*f* abuts against the regulation portions 407 and 503 (see FIG. 9A). The both end portions (300*e* and 300*f*) in the longitudinal direction of the LED head 105 abut against the regulation portions 406, 407, 503, and 504 serving as the regulation unit so that the LED head 105 is positioned at the exposure position (see FIG. 4A, FIG. 7A, FIG. 9A, and FIG. 9B).

In contrast, when the lever 201 is rotated in a direction indicated by the arrow A of FIG. 7A, as illustrated in FIG. 7B, the cams 203 press the another end portions of the links 204. The action of the cams 203 causes the one end portions of the links 204 to compress the compression springs 206 against the biasing force of the compression springs 206. Therefore, the LED head 105 moves to the retracted position (see FIG. 4B and FIG. 7B) by its own weight or by the biasing force of the biasing members (not shown).

(Cleaning Member)

Figure 10A:
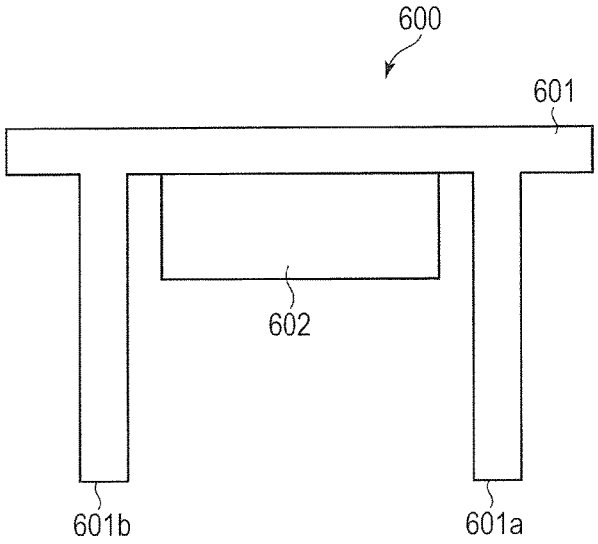
FIG. 10A and FIG. 10B are views for illustrating a cleaning member.
Figure 10B:
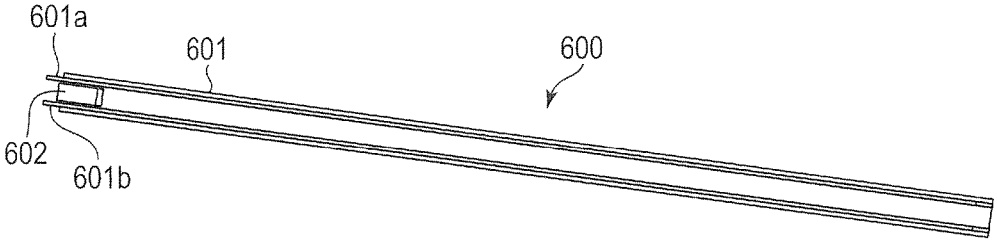
Figure 11A:
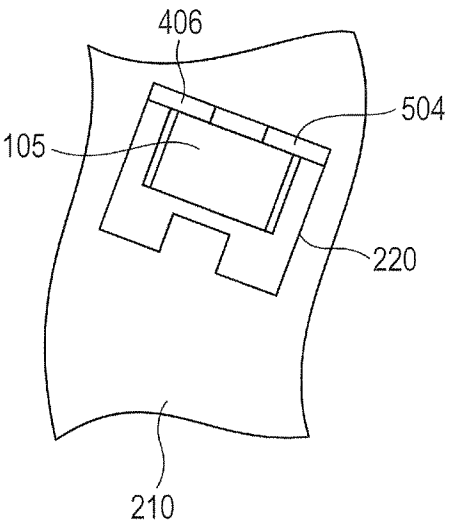
FIG. 11A, FIG. 11B, and FIG. 11C are views for illustrating the LED head as seen through an opening portion of the main body frame.
Figure 11B:
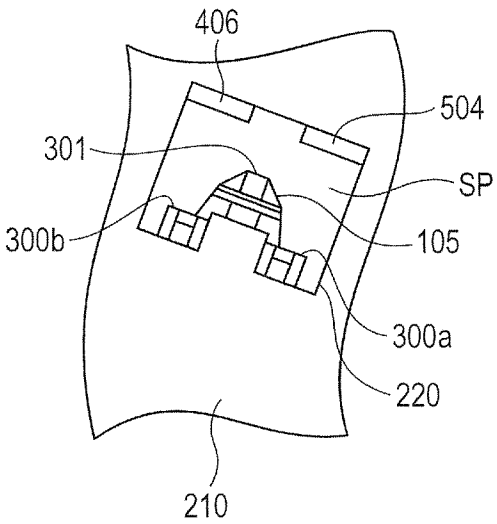
Figure 11C:
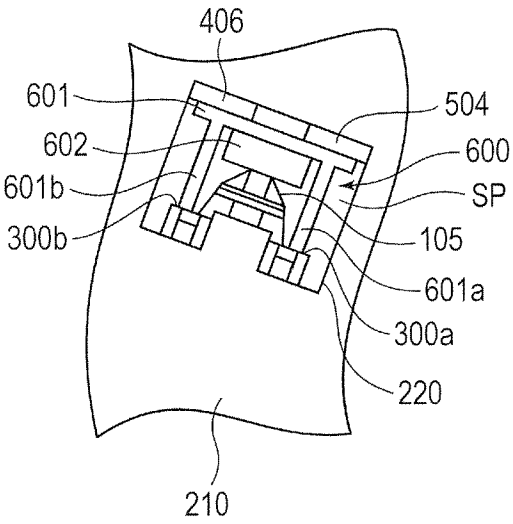

Now, with reference to FIG. 10A, FIG. 10B, FIG. 11A, FIG. 11B, and FIG. 11C, a description will be provided of the cleaning member 600. FIG. 10A and FIG. 10B are views for illustrating the cleaning member 600. FIG. 10A is a sectional view of the cleaning member 600. FIG. 10B is a perspective view of the cleaning member 600. FIG. 11A, FIG. 11B, and FIG. 11C are views for illustrating the LED head 105 as seen through an opening portion 220 of the main body frame 210. FIG. 11A is a view for illustrating the LED head 105 as seen through the opening portion 220 of the main body frame 210 when the LED head 105 is at the exposure position close to the photosensitive drum 103 for image formation. FIG. 11B is a view for illustrating the LED head 105 as seen through the opening portion 220 of the main body frame 210 when the LED head 105 is at the retracted position apart from the photosensitive drum 103. FIG. 11C is a view for illustrating the LED head 105 and the cleaning member 600 as seen through the opening portion 220 of the main body frame 210 when the cleaning member 600 is inserted into the main body 120 of the image forming apparatus 100 for cleaning of the LED head 105.

As illustrated in FIG. 10A, the cleaning member 600 includes a cleaning rod 601 and the cleaning pad (cleaning portion) 602. The cleaning pad 602 may be a blade made of PET resin. The cleaning rod 601 is an elongated component including protrusions 601*a* and 601*b* and having a substantially U-shaped cross section. The protrusions 601*a* and 601*b* extend in a longitudinal direction of the cleaning rod 601 in parallel to each other. The cleaning pad 602 is fixed on an inner side of the substantially U-shaped cross section at one end portion of the cleaning rod 601 in the longitudinal direction. As illustrated in FIG. 8, in order to allow insertion of the cleaning member 600 into the main body 120 of the image forming apparatus 100, the opening portion (cutout portion) 220 is formed in the main body frame 210. FIG. 11A, FIG. 11B, and FIG. 11C are illustrations of the opening portion 220 formed in the main body frame 210. The opening portion 220 is formed into a U-shape. However, the shape of the opening portion 220 is not limited to the U-shape, and may be, for example, a rectangular shape, a circular shape, or a cutout shape having an open end. As can be seen in FIG. 11A, when the LED head 105 is at the exposure position for image formation, that is, when the LED head 105 is close to the photosensitive drum 103, the lens assembly 301 of the LED head 105 cannot be seen through the opening portion 220. As illustrated in FIG. 11B, when the LED head 105 is at the retracted position apart from the photosensitive drum 103, that is, when the LED head 105 is apart from the photosensitive drum 103, the lens assembly 301 of the LED head 105 can be seen through the opening portion 220. As a result of the movement of the LED head 105 to the retracted position, a space SP for allowing the insertion of the cleaning member 600 is formed between the photosensitive drum 103 and the LED head 105. As illustrated in FIG. 11C, when the LED head 105 is at the retracted position apart from the photosensitive drum 103, the cleaning member 600 is inserted into the space SP in the main body 120 of the image forming apparatus 100 through the opening portion 220 serving as a guide unit. The opening portion 220 serving as the guide unit guides the cleaning member 600 from an outside to an inside of the main body 120 of the image forming apparatus 100.

As illustrated in FIG. 11A, FIG. 11B, and FIG. 11C, the regulation portion 406 provided to the developing frame 404 and the regulation portion 504 provided to the drum frame 501 can be seen through an upper side of the opening portion 220. The regulation portions 406 and 504 regulate the upward movement of the cleaning rod 601 during cleaning of the LED head 105 described later, thereby preventing the cleaning rod 601 from being brought into contact with the photosensitive drum 103. The regulation portions 406 and 504 function as a regulation unit configured to regulate the movement of the cleaning member 600 toward the photosensitive drum 103. The regulation portion 406 of the developing frame 404 may be omitted. The regulation portion 504 of the drum frame 501 may be configured to regulate the movement of the cleaning rod 601 toward the photosensitive drum 103 without use of the regulation portion 406 of the developing frame 404.

As illustrated in FIG. 11B and FIG. 11C, two surfaces (regulation surfaces) 300*a* and 300*b* provided to the housing 300 of the LED head 105 can be seen through a lower side of the opening portion 220. The surfaces 300*a* and 300*b* are arranged across the lens assembly 301 and extend in the longitudinal direction of the LED head 105. One surface 300*a* of the two surfaces 300*a* and 300*b* is capable of abutting against one protrusion 601*a* of the two protrusions 601*a* and 601*b* provided to the cleaning rod 601. Another surface 300*b* of the two surfaces 300*a* and 300*b* is capable of abutting against another protrusion 601*b* of the two protrusions 601*a* and 601*b*. During cleaning of the LED head 105 described later, the surfaces 300*a* and 300*b* regulate the downward movement of the cleaning rod 601, thereby preventing the cleaning rod 601 from being brought into contact with the lens assembly 301. When the cleaning rod 601 is brought into contact with the lens assembly 301, a lens surface of the lens assembly 301 may be damaged. Therefore, the surfaces 300*a* and 300*b* provided to the housing 300 of the LED head 105 receive the protrusions 601*a* and 601*b* of the cleaning rod 601, respectively. With this configuration, the surfaces 300*a* and 300*b* function as the regulation unit configured to regulate the movement of the cleaning member 600 toward the LED head 105.

The surfaces 300*a* and 300*b* of the LED head 105 are arranged closer to the photosensitive drum 103 than the both end portions 300*e* and 300*f* of the LED head 105 which abut against the regulation portions 406, 407, 503, and 504. When the both end portions 300*e* and 300*f* of the LED head 105 abut against the regulation portions 406, 407, 503, and 504 so that the LED head 105 is positioned at the exposure position, the light emission surface 301*a* of the lens assembly 301 is closer to the photosensitive drum 103 than the both end portions 300*e* and 300*f*.

(Cleaning Method for Lens Assembly)

Now, a description will be provided of cleaning procedures for the lens assembly 301 of the LED head 105.

Cleaning Procedure (1): The LED head 105 is moved to the retracted position (separation position).

When a user grips the lever (grip portion) 201 and rotates the lever 201 in the direction indicated by the arrow A of FIG. 7A, as illustrated in FIG. 7B, the action of the cams 203 causes the links 204 to compress the compression springs 206, thereby moving the LED head 105 to the retracted position.

Cleaning Procedure (2): The cleaning member 600 is inserted into the space SP formed as a result of the movement of the LED head 105 to the retracted position.

The cleaning member 600 is inserted through the opening portion 220 formed in the main body frame 210 and then is slidingly moved to the far side FS while allowing the cleaning rod 601 in an upper portion of the cleaning member 600 to be along the regulation portions 406 and 504 and allowing lower portions of the protrusions 601*a* and 601*b* to be along the surfaces 300*a* and 300*b* of the housing 300. The regulation portions 405, 406, 407, 502, 503, and 504 and the surfaces 300*a* and 300*b* allow movement of the cleaning member 600 along the light emission surface 301*a* while allowing only cleaning pad 602 to be held in contact with the light emission surface 301*a* of the lens assembly 301 for rubbing. The regulation portions 405 and 502 are provided to the developing cartridge 400 and the drum cartridge 500, respectively, so that the cleaning member 600 is prevented from being brought into contact with the surface of the photosensitive drum 103 when the cleaning member 600 slidingly moves in the longitudinal direction of the light emission surface 301*a*. Further, the regulation portions 405 and 502 are provided to the developing cartridge 400 and the drum cartridge 500, respectively, so that the cleaning pad 602 is prevented from being separated from the light emission surface 301*a* when the cleaning pad 602 slidingly moves in the longitudinal direction of the light emission surface 301*a*. The regulation portions 405 and 502 bias the cleaning pad 602 against the light emission surface 301*a*. The cleaning pad 602 rubs the light emission surface 301*a* of the lens assembly 301 to wipe off dirt on the light emission surface 301*a*.

Cleaning Procedure (3): After the cleaning is terminated, the cleaning member 600 is drawn out from the main body 120 of the image forming apparatus 100.

The cleaning member 600 is slidingly moved toward the near side NS.

Cleaning Procedure (4): The LED head 105 is moved to the exposure position (image formation position).

When a user grips the lever 201 and rotates the lever 201 in the direction indicated by the arrow B of FIG. 7B, as illustrated in FIG. 7A, the engagement of the links 204 with the cams 203 is released, and the LED head 105 is moved by the compression springs 206 to the exposure position. The one end portion 300*e* of the housing 300 of the LED head 105 abuts against the regulation portions 406 and 504, and the another end portion 300*f* abuts against the regulation portions 407 and 503, thereby positioning the LED head 105 in the direction indicated by the arrow C in the main body 120 of the image forming apparatus 100. Further, at this time, the LED head 105 is positioned by the regulation portions 405 and 502 in the direction indicated by the arrow D.

According to the first embodiment, the positioning unit, which is configured to position the LED head 105 to the exposure position at which the LED head 105 is close to the photosensitive drum 103 for image formation, can be constructed by the developing frame 404 and the drum frame 501. Further, according to the first embodiment, the regulation unit, which is configured to regulate the movement of the cleaning member 600, can be constructed by the developing frame 404, the drum frame 501, and the housing 300 of the LED head 105. Therefore, the image forming apparatus 100 can be downsized. Further, according to the first embodiment, the cleaning member 600 guided by the guide unit is capable of reliably cleaning the light emission surface 301*a* of the lens assembly 301 of the LED head 105.

Second Embodiment

Now, a description will be provided of a second embodiment. In the second embodiment, the structures similar to those of the first embodiment are denoted by the same reference symbols, and description thereof is omitted. In the second embodiment, the image forming apparatus 100, the LED head 105, the developing device 106, the drum cartridge 500, the approach/separation mechanism 200, and the cleaning member 600 are the same as those of the first embodiment, and hence description thereof is omitted. The second embodiment is different from the first embodiment in that guide members 221 and 222 configured to guide the movement of the LED head 105 are provided to the main body frame 221.

Figure 12:
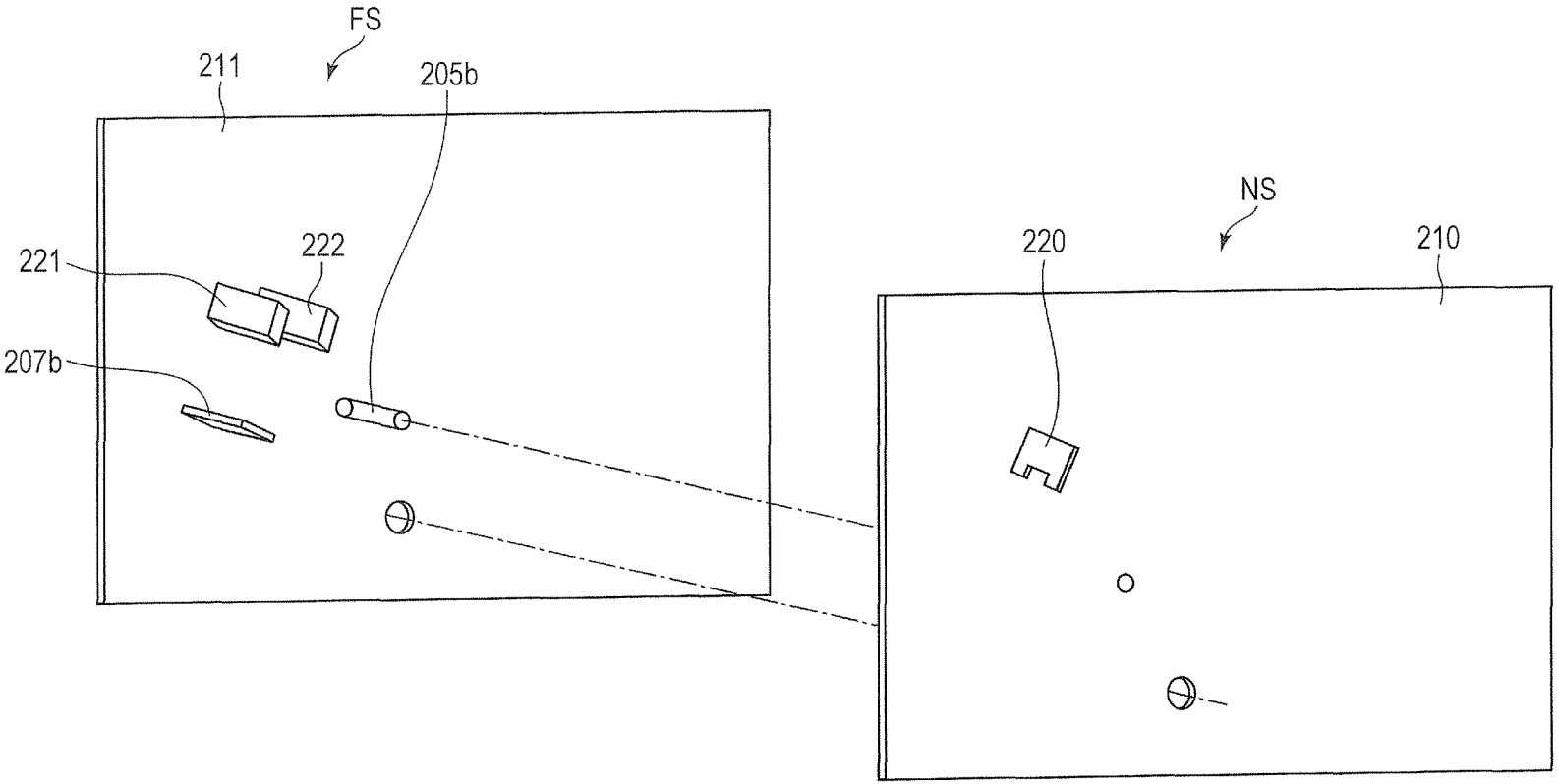
FIG. 12 is a perspective view of main body frames of a second embodiment.
Figure 13A:
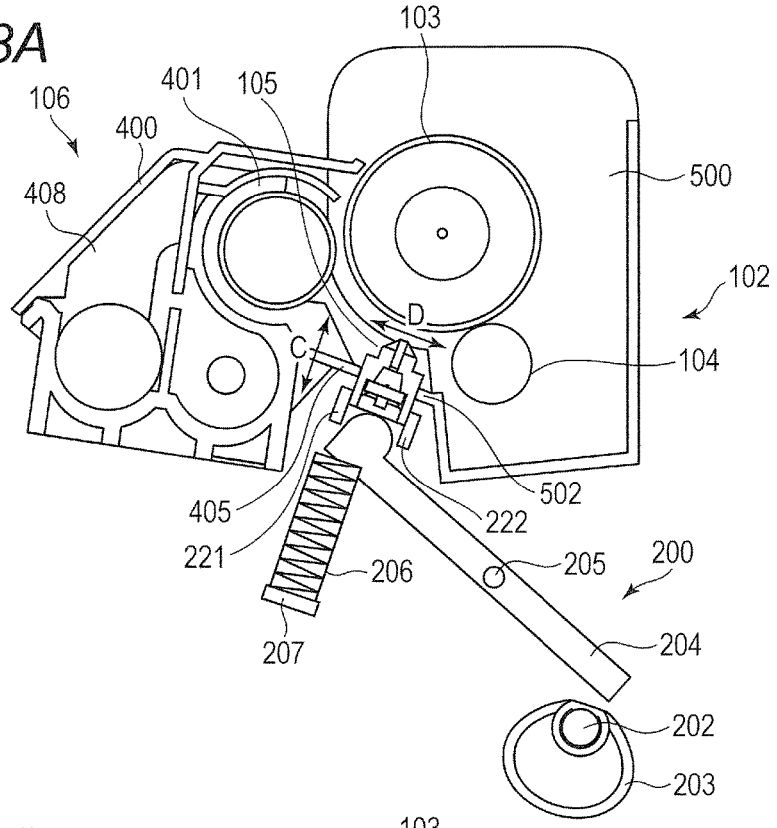
FIG. 13A and FIG. 13B are sectional views of an image forming portion of the second embodiment.
Figure 13B:
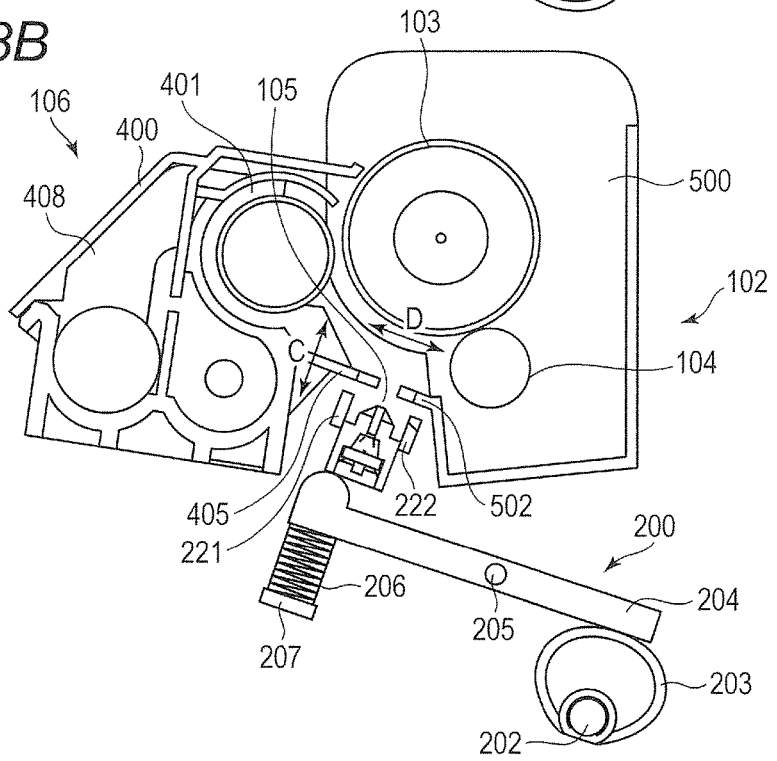

FIG. 12 is a perspective view of main body frames 210 and 211 of the second embodiment. The guide members 221 and 222 configured to guide the movement of the LED head 105 are provided so as to protrude from the main body frame 211. FIG. 13A and FIG. 13B are sectional views of an image forming portion 102 of the second embodiment. FIG. 13A is a sectional view of the image forming portion 102 under a state in which the LED head 105 of the second embodiment is at the exposure position. During the image formation, the LED head 105 is at the exposure position illustrated in FIG. 13A. FIG. 13B is a sectional view of the image forming portion 102 under a state in which the LED head 105 of the second embodiment is at the retracted position apart from the photosensitive drum 103. During the cleaning, the LED head 105 is at the retracted position illustrated in FIG. 13B. As illustrated in FIG. 13A and FIG. 13B, the guide members 221 and 222 are provided below the regulation portions 405 and 502 so as to protrude from the main body frame 211. With this configuration, the position of the LED head 105 in the direction indicated by the arrow D can always be regulated, thereby being capable of positioning the LED head 105. The guide members 221 and 222 may protrude from the main body frame 210 instead of the main body frame 211. Alternatively, the guide members 221 and 222 may protrude from both the main body frame 211 and the main body frame 210. According to the second embodiment, the effect similar to that of the first embodiment can be achieved.

According to the first embodiment and the second embodiment, the cleaning portion provided to the cleaning member can be brought into contact with the light emission surface of the lenses of the light emitting device without bringing the cleaning member into contact with the photosensitive drum.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-198241, filed Oct. 6, 2016, which is hereby incorporated by reference herein in its entirety.

What is claimed is:

1. An image forming apparatus, which is configured to form an image on a recording medium, comprising:

a cartridge, which includes a photosensitive drum being rotatable and a regulation portion, and is detachably mounted to a main body of the image forming apparatus;

a light emitting device, comprising:

a plurality of light emitting points, which are arrayed in a direction intersecting a rotation direction of the photosensitive drum and are configured to emit light in accordance with image information so as to form an electrostatic latent image on a surface of the photosensitive drum; and a lens, which is configured to image light emitted from the plurality of light emitting points on the surface of the photosensitive drum and has a light emission surface configured to emit the light from the plurality of light emitting points and arranged opposite to the surface of the photosensitive drum; and a movement unit configured to reciprocate the light emitting device between an exposure position and a retracted position, the exposure position being a position for formation of the electrostatic latent image and being a position at which the light emission surface is positioned closer to the surface of the photosensitive drum with respect to the regulation portion of the cartridge, the retracted position being a position retracted from the exposure position and being a position at which the light emission surface is positioned on a side of the regulation portion of the cartridge that is opposite to the surface of the photosensitive drum, wherein the regulation portion of the cartridge regulates a cleaning member, which includes a cleaning portion configured to rub and clean the light emission surface by a sliding movement of the cleaning member in a longitudinal direction of the light emitting device on the light emission surface of the light emitting device positioned at the retracted position, so as to prevent the cleaning member from being brought into contact with the surface of the photosensitive drum and so as to bias the cleaning portion against the light emission surface to prevent the cleaning portion from being separated from the light emission surface in the longitudinal direction of the light emitting device during the sliding movement of the cleaning member.

2. An image forming apparatus according to claim 1, further comprising a guide unit configured to guide the cleaning member to a space formed between the photosensitive drum and the light emitting device when the light emitting device is at the retracted position.

3. An image forming apparatus according to claim 1, wherein the guide unit comprises an opening portion formed in a frame of the main body.

4. An image forming apparatus according to claim 1, further comprising positioning portions provided on both end portions of the regulation portion of the cartridge, wherein both end portions of the light emitting device in the longitudinal direction abut against the positioning portions so that the light emitting device is positioned at the exposure position.

5. An image forming apparatus according to claim 1, wherein the cartridge comprises a drum cartridge integrally including the photosensitive drum and a charger configured to uniformly charge the surface of the photosensitive drum.

6. An image forming apparatus according to claim 1, wherein the cartridge comprises a process cartridge integrally including the photosensitive drum, a charger configured to uniformly charge the surface of the photosensitive drum, and a developing member configured to develop the electrostatic latent image, which is formed on the surface of the photosensitive drum by the light emitting device, with developer.

7. An image forming apparatus according to claim 1, further comprising a developing cartridge including a developing member configured to develop the electrostatic latent image, which is formed on the surface of the photosensitive drum by the light emitting device, with developer, and a regulation portion of the developing cartridge, the developing cartridge being detachably mounted to the main body of the image forming apparatus, wherein the regulation portion of the developing cartridge, together with the regulation portion of the cartridge, regulates the cleaning member, which includes the cleaning portion, so as to prevent the cleaning member from being brought into contact with the surface of the photosensitive drum and so as to bias the cleaning portion against the light emission surface to prevent the cleaning portion from being separated from the light emission surface in the longitudinal direction of the light emitting device during the sliding movement of the cleaning member.

8. An image forming apparatus according to claim 1, wherein the light emitting device has two surfaces interposing the lens therebetween and extending in the longitudinal direction, wherein one surface of the two surfaces is abuttable against one protrusion of two protrusions provided on the cleaning member, and wherein another surface of the two surfaces is abuttable against another protrusion of the two protrusions.

9. An image forming apparatus according to claim 1, further comprising a guide portion configured to guide movement of the light emitting device between the exposure position and the retracted position.

10. An image forming apparatus according to claim 1, wherein the movement unit includes a grip portion which is to be gripped and operated by a user, and wherein the movement unit moves the light emitting device between the exposure position and the retracted position in conjunction with movement of the grip portion by an operation of the user.

* * * * *